US005939992A

United States Patent [19]

Devries et al.

[11] Patent Number: 5,939,992

[45] Date of Patent: Aug. 17, 1999

[54] SAFETY APPARATUS FOR ELECTRIC APPLIANCES

[76] Inventors: Wilbur Devries, 10831 -147 Street, Edmonton Alberta, Canada, T5N 3E1; Debra Elm, 37 Willowdale Place, Edmonton, Alberta, Canada, T5T 1Z4

[21] Appl. No.: 08/826,521

[22] Filed: Apr. 3, 1997

[51] Int. Cl.[6] ..... G08B 21/00

[52] U.S. Cl. ..... 340/657; 340/309.3; 340/309.4; 340/309.5; 340/384.72; 340/635; 361/87; 327/72

[58] Field of Search ..... 340/309.15, 309.3, 340/309.4, 309.5, 309.6, 384.7, 384.71, 384.72, 635, 653, 657, 660, 664, 575; 307/130, 131; 361/87; 327/72

[56] References Cited

U.S. PATENT DOCUMENTS

| | | | |
|---|---|---|---|
| 4,104,541 | 8/1978 | Jewell | 340/309.15 |
| 4,191,328 | 3/1980 | Isaaca et al. | 340/309.4 |
| 4,255,669 | 3/1981 | Naugle | 340/664 |
| 5,289,158 | 2/1994 | Neves | 340/309.15 |
| 5,467,077 | 11/1995 | Wunderlich et al. | 340/635 |
| 5,684,455 | 11/1997 | Williams et al. | 340/309.4 |
| 5,686,881 | 11/1997 | Ridout | 340/309.15 |

*Primary Examiner*—Daniel J. Wu
*Attorney, Agent, or Firm*—Anthony R. Lambert

[57] ABSTRACT

A safety apparatus for electric appliances which includes a sensor for sensing that an electric appliance is operating. An alarm coupled with the sensor, whereby an alarm is initiated. A manually operated alarm disabling switch permitting a person supervising the operation of the electric appliance to temporarily disable the alarm for a predetermined time interval.

7 Claims, 5 Drawing Sheets

SAFETY APPARATUS FOR ELECTRIC APPLIANCES

FIELD OF THE INVENTION

The present invention relates to a safety apparatus for electric appliances and, in particular, electric stoves.

BACKGROUND OF THE INVENTION

It is common for persons to be interrupted while using electric appliances. They may be interrupted by a ringing of a doorbell, a ringing of a telephone or they may remember a task that they feel they can quickly complete while they wait. A person without memory problems remembers to return to the electric appliance after the interruption has been attended to. A person with a memory problem may not. If a person with a memory problem forgets to return to attend to an electric clothes dryer, it does not present a serious safety problem. However, if the person with a memory problem forgets to return to attend to an electric stove, a fire may result. Some persons with memory problems, realizing the risk, no longer use their stoves. Persons with more pronounced memory problems will continue to cook in an unsafe manner.

Swedish Application 9,102,230 teaches the use of a timing circuit which is coupled to the power supply for an electric appliance. The timer must be set in order for current to flow to the electric appliance. Upon expiration of the time, the flow of current to the electric appliance is cut off. A key activated bypass of the timer is provided for use by persons without memory lose.

The teachings of Swedish Application 9,102,230 are effective to prevent fires. Unfortunately, such teachings do not assist the person with memory loss to complete the task of cooking, preferably without burning the food. In order to remain in their homes persons with memory loss must be able to complete routine household tasks, notwithstanding their memory problems.

SUMMARY OF THE INVENTION

What is required is a safety apparatus for electric appliances that will assist a person with memory problems to complete routine household tasks, such as cooking.

According to the present invention there is provided a safety apparatus for electric appliances which includes sensing means for sensing that an electric appliance is operating. Alarm means are coupled with the sensing means, whereby an alarm is initiated upon the electric appliance operating. Alarm disabling means are provided for disabling the alarm means for a predetermined time interval. In the preferred embodiment the alarm disabling means has a manual reset switch whereby a person supervising the operation of the electric appliance restarts the predetermined time interval.

The safety apparatus, as described above, an alarm sounds to remind the person supervising the use of the electric appliance to return to his or her task. It will also alert the spouse of a memory impaired person, that the electric appliance has been turned on. When the electric appliance is a stove, the task is one of stirring their porridge, turning their meat, and the like. The person supervising the operation of the electric appliance can temporarily disable the alarm by pressing the manual reset switch. There are different alarm means that could be used. The preferred form of alarm means is an audible alarm, as it is easier to catch the attention of a person in the next room with an audible alarm as opposed to flashing lights. A different form of alarm means would have to be used by the hearing impaired. The most practical being a vibration pager that they could carry upon their person. Of course, the benefits of the safety apparatus described are not limited to persons with memory problems. Even persons without memory problems commonly remove a pot from the stove and forget to turn the stove element off. The safety apparatus, as described above, would call them back to the stove if the element was inadvertently left on.

Although beneficial results may be obtained through the use of the invention, as described above, there is always a possibility that the person using the appliance has left his residence or is otherwise out of hearing range of the audible alarm. Even more beneficial results may, therefore, be obtained when switch means are provided for turning off the stove should the alarm disabling means not be reset within a second predetermined time interval. It should be noted that the cutting off of the power to the electric appliance is a matter of last resort. It is preferred that the person using the appliance be assisted by the safety apparatus described in completing the task undertaken.

There are various means for determining whether the electric appliance is in operation. It is preferred that sensors be used to monitor that fact that power is being consumed by the electric appliance. There are various sensors commercially available that will do this by sensing current or voltage.

The teachings of this safety apparatus can be implemented in several ways. An apparatus, as described above, can be incorporated into the manufacture of a new electric appliance and, in particular, a stove. It is also possible to incorporate the safety apparatus in a plug adaptor unit into which the electric appliance is plugged.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
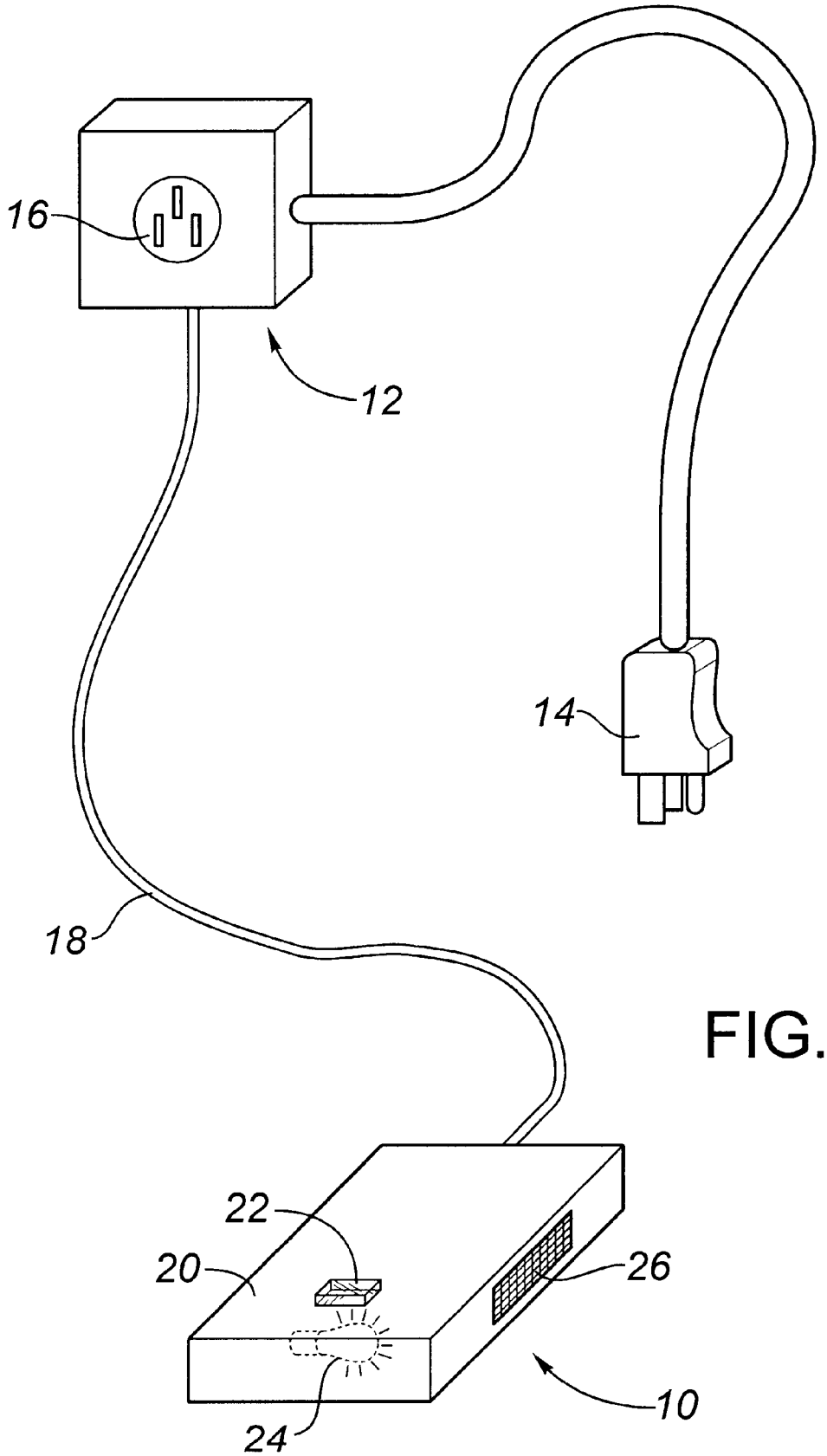
FIG. 1 is a perspective view of a plug adaptor unit incorporating the teaching of the present safety apparatus for electric appliances.

The preferred embodiment, a safety apparatus for electric appliances generally identified by reference numeral 10, will now be described with reference to FIGS. 1 through 3*a*, 3*b*, 3*c*. The teachings relating to the present invention can easily be incorporated into an electrical appliance. The manner in which safety apparatus 10 can be adapted for use with existing apparatus will now be described.

Referring to FIG. 1, the illustrated embodiment of safety apparatus 10 includes a plug adaptor 12 having a male portion 14 adapted for insertion into a residential electric outlet (not shown) and a female portion 16 adapted to receive a plug from an electric appliance (not shown). Plug adaptor 12 is connected by a conductive wire 18 to a housing 20. Housing 20 has a button form manual reset switch 22, a light 24 and a audio speaker sound grid 26 to allow sound to pass from speakers positioned within housing 20, as will hereinafter be further described.

Figure 2:
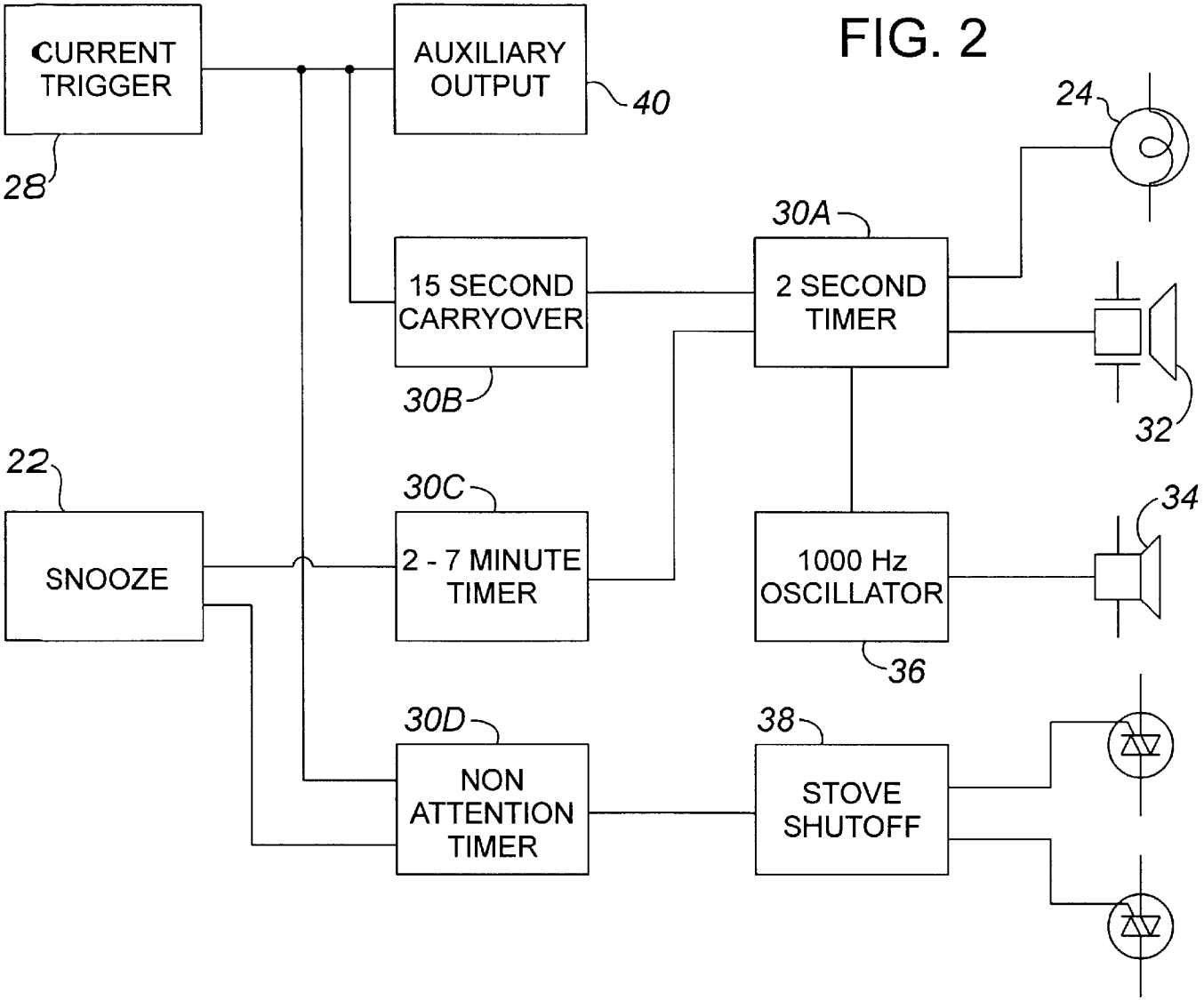
FIG. 2 is a block diagram of a preferred embodiment of the safety apparatus for electric appliances.

Referring to FIG. 2, there is illustrated in block form the components that are electrically coupled with plug adaptor 12. A power consumption sensor 28 detects power consumption by the electric appliance to let safety apparatus 10 know that the electric appliance is operating. Power consumption sensor 28 in this case is triggered by current draw. In an application involving an electric stove, it is preferred that sensor 28 have a 3.5 amp threshold to permit operation of the stove clock and lights without activating safety apparatus 10. Apparatus 10 allows the clock and lights to work, while monitoring use of the stove top elements, the oven, or an appliance plugged an electric receptacle on the stoves's control panel. Timing means coupled with sensor 28 play a role in both an alarm means and an alarm disabling means as will hereinafter be further described. In FIG. 2, the timing means are illustrated as a series of blocks representing individual timing circuits 30*a*, 30, 30*c*, 30*d* each of which performs a particular timing function as will hereinafter further be described. Upon receiving a signal from sensor 28 that the electric appliance is consuming power, a number of the timing circuits become active. Timing circuit 30*a* is connected to light 24, a first speaker 32 and a second speaker 34. Light 24 is illuminated when safety apparatus 10 is first activated and is caused to flash by timing circuit 30*a*. Similarly, first speaker 32 emits a 3500 hz tone when safety apparatus 10 is first activated and continues to emit such tone as long as safety apparatus 10 is in operation. Beneficial results have been obtained when timing circuit 30*a* causes light 24 to flash and first speaker 32 emit a tone once per second. Timing circuit 30*b* is a carry over circuit which causes light 24 to flash and first speaker 32 to emit a tone approximately 15 seconds after current is no longer being sensed. A second speaker 34 serves a primary alarm function emitting a 1000 hz audible alarm tone upon sensor 28 sensing current flow. It is preferred that the audible alarm tone be modulated through the use of an oscillating circuit 36. Light 24, first speaker 32 and second speaker 34 are all connected to alarm disabling means which includes manual reset switch 22 and timing circuit 30*c*. By pressing manual reset switch 22, timing circuit 30*c* deactivates light 24, first speaker 32 and second speaker 34 for a first predetermined time interval. Timing circuit 30*c* works in a manner that is analogous to a "snooze" button on an alarm clock. At the expiration of the first predetermined time interval light 24, first speaker 32 and second speaker 34 will again be operative with first speaker 32 emitting a 3500 hz audible alarm tone and second speaker 34 emitting a 1000 hz audible alarm tone. The first predetermined time interval is, preferably, between 2 and 7 minutes. First speaker 32 and second speaker 34 will continue sounding the audible alarm warning tones until manual reset switch 22 is pressed. An additional feature is the provision of an automatic power cutoff switch 38 coupled to timing circuit 30*d*. Timing circuit 30*d* times a second predetermined time interval. If the audible warning tones emitted by first speaker 32 and second speaker 34 are not acknowledged by pressing manual reset switch 22 within the second predetermined time interval, timing circuit 30*d* will trigger power cutoff switch 38. The second predetermined time interval is, preferably, between 15 and 25 minutes. Every time manual reset switch 22 is pressed, timing circuit 30*d* is reset. A desirable option is to have an auxiliary output 40. Auxiliary output 40 enables remote monitoring, as will hereinafter be further described.

Figure 3A:
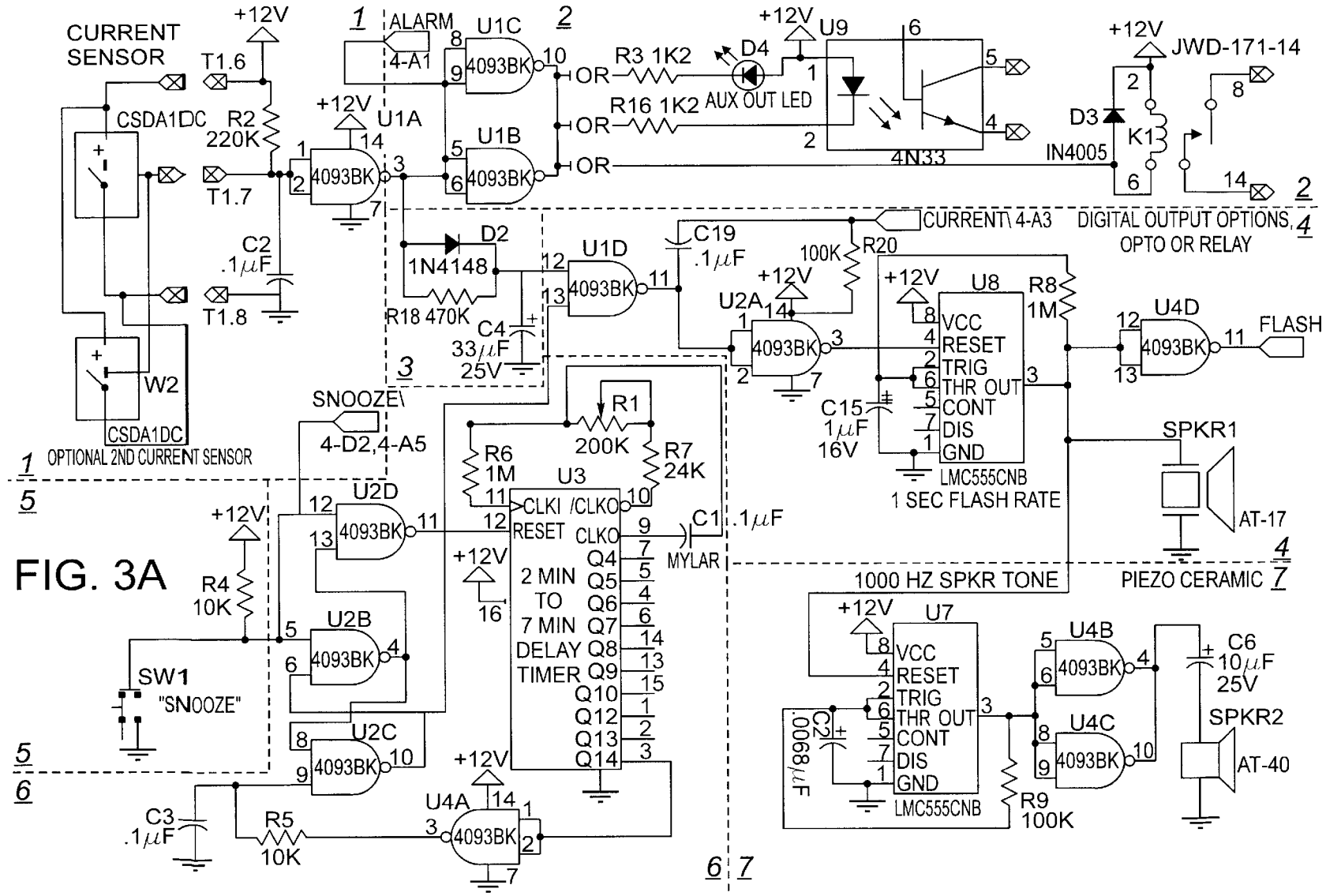
FIGS. 3*a*, 3*b*, 3*c* are circuit diagrams of the safety apparatus for electric appliances.
Figure 3B:
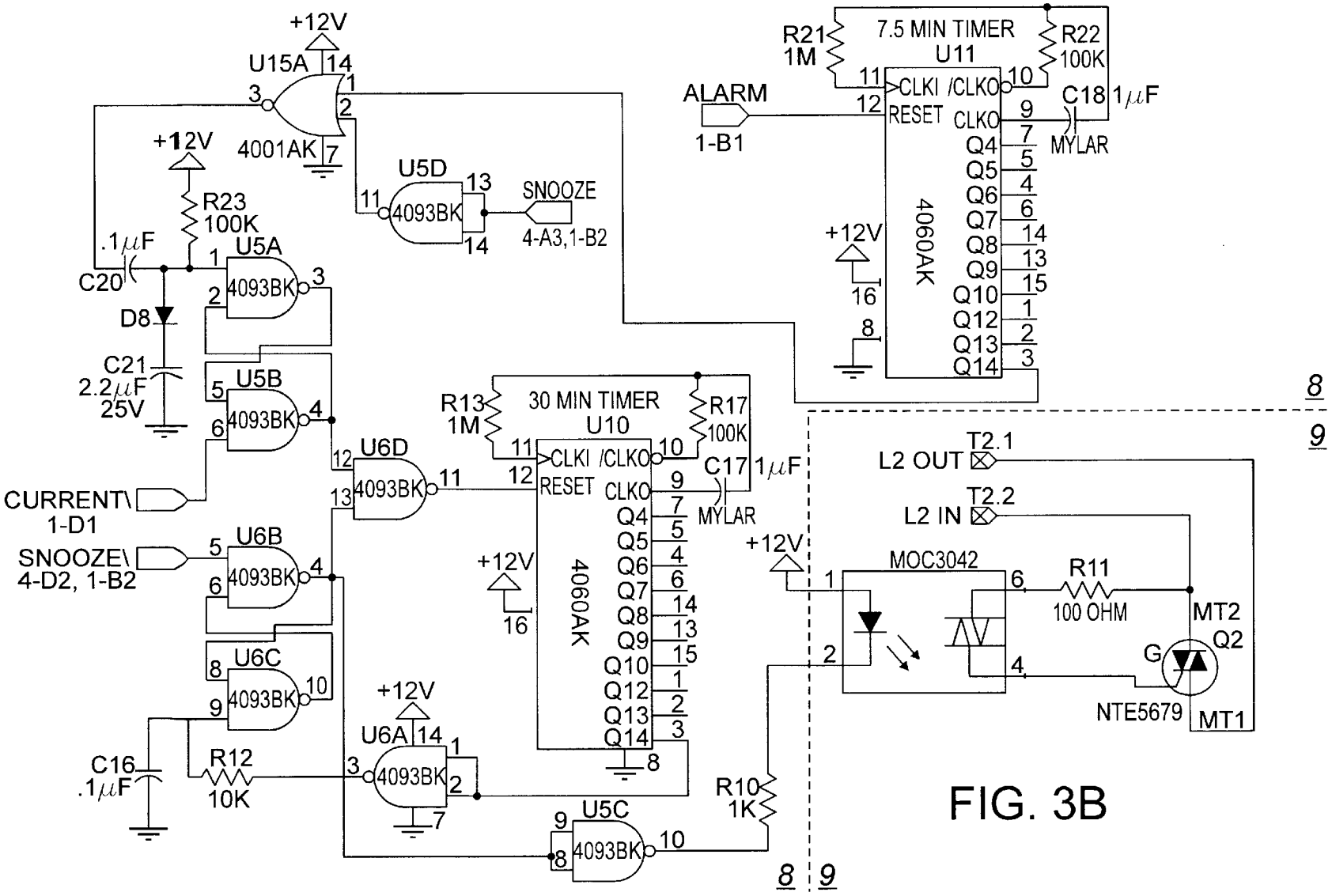
Figure 3C:
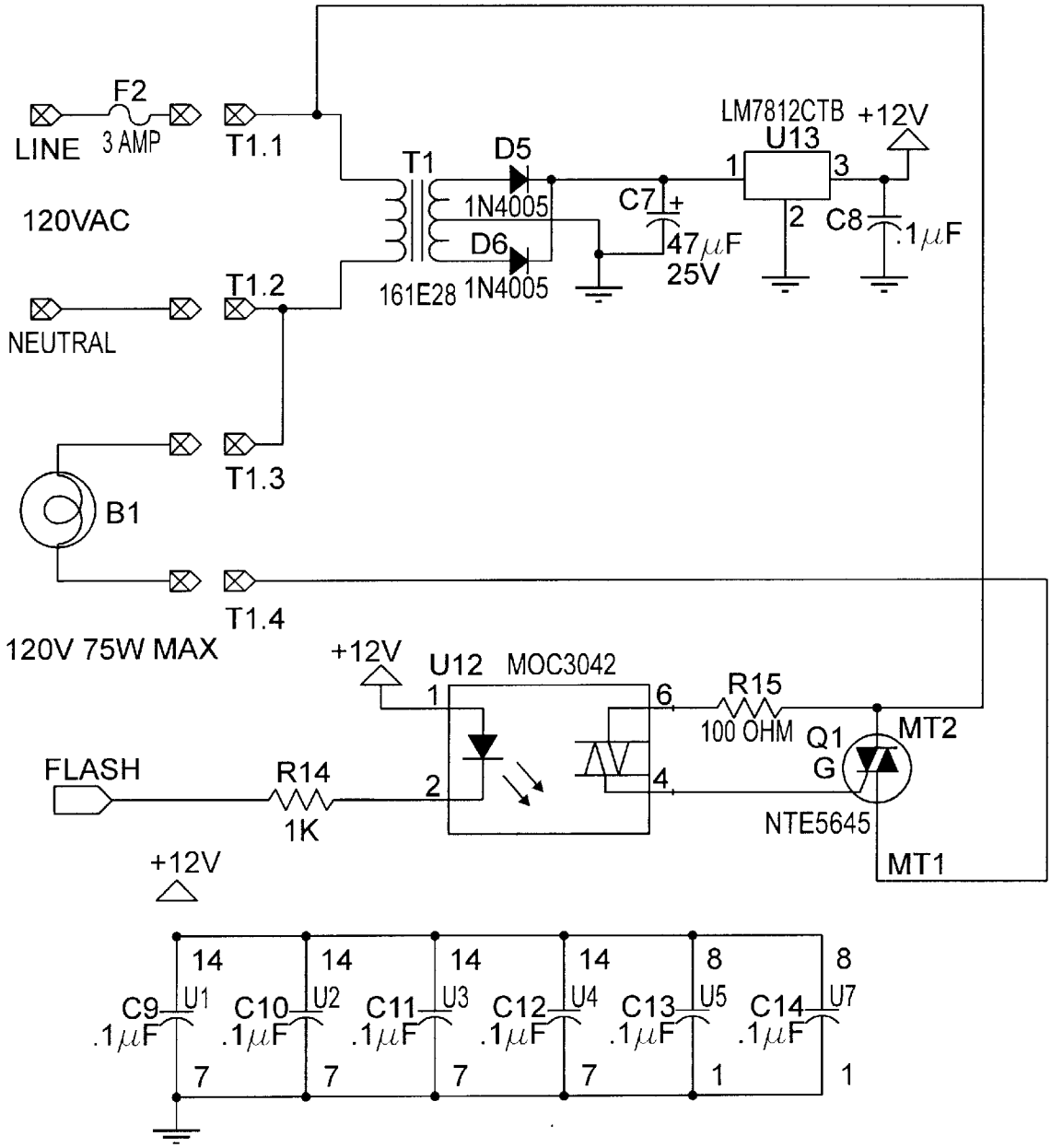

FIGS. 3*a*, 3*b* and 3*c*, illustrate circuitry underlying the blocks in block diagram FIG. 2. The circuits were made with commercially available components, utilizing a series of gates to implement circuit logic. Referring to FIG. 3*a*, timing circuit 30*c* that includes a timing chip U3, resistors R1, R5, R6, R7, Capacitor C3, and a number of gates U2*c*, U2*c*, U2*d* and U4*a* which are used to implement the circuit logic. Two of the gates, U2*c* and U2*b*, are configured as a flip-flop. Resistor R5 and a capacitor C3 are configured to create a resistor/capacitor time delay. Upon power up output Q14 from timer U3 is low, causing output 3 of gate U4*a* to go high. R5/C3 ensure that timer U3 is enabled during power up in a known condition, this results in a delay that leaves input 9 to gate U2*c* low. This causes output 10 of gate U2*c* to go high and output 4 of gate U2*b* to go low. As a result input 13 into gate U2*d* is low. Input 12 into gate U2*d* is, however, high which causes output 11 of gate U2*d* to be high. A high output at output 11 of gate U2*d* feeds into input 12 of timing chip U3, to reset timing chip U3. A snooze button 22 effects the operation of timing circuit 30*c* as will hereinafter be described.

Sensing circuit 28 includes resistor R2, capacitor C2, terminal connections T1.6, T1.7, T1.8 and a gate U1*a*. Capacitor C2 serves to provide a steady output, notwithstanding the alternating current input. When current flows output 3 of gate U1*a* goes to high.

Timing circuit 30*b* includes diode D2, resistor R18, and Capacitor C4. When current flows through timing circuit 30*b*, capacitor C4 acquires a charge. The use of diode D2 in combination with resistor R18 results in capacitor charging quickly, while discharging relatively slowly. This provides a 15 second carry over as capacitor C4 discharges after the flow of current is terminated.

Gate U1*d* controls the alarm portion of the circuit. Input 12 of gate U1*d* comes from output 3 of gate U1*a* of sensing circuit 28 via timing circuit 30*b*. Input 13 of gate U1*d* comes from output 10 of gate U2*c* of timing circuit 30*c*. When input 13 is high and input 12 is high, output 11 of gate U1*d* goes to low initiating the alarm.

The alarm portion of the circuit includes timing circuit 30*a*, light 24, first speaker 32, second speaker 34 and oscillator 36. Timing circuit 30*a* includes 555 flasher U8, gates U2*a* and U4*d*, resistors R20, R8, and capacitors C15, C19. Capacitor C19 is used to send a pulsing transition signal through to gate U5*b* which is illustrated in FIG. 3*b*, and will hereinafter be further described. Gate U5*b* is configured as a flip flop with gate U5*a*. Referring to FIG. 3*a*, gate U2*a* is used to reset 555 flasher U8. Capacitor C15 is used to create a one or two second delay, which creates an alternative "on" and "off" cycle of current flow to light 24, first speaker 32, and second speaker 34. First speaker 32 is directly connected and emits a tone during the "on" cycle. Gate U4*d* turns light 24, which is illustrated in FIG. 3*c*, on and off. The same signal also feeds into oscillator circuit 36 which effects output of second speaker 34. Oscillator circuit 36 includes 555 flasher U7, capacitor C5, resistor R9, gates U4*b* and U4*c*. Output from 555 flasher U8 feeds into reset for 555 flasher U7. Capacitor C5 is used to create a 1000 hz tone. Gates U4*b* and U4*c* are used to control the power input to second speaker 34.

When snooze button 22 is pressed and then released inputs 12 and 13 of gate U2*d* go to high, making output 11 of gate U2*d* go to low starting timing chip U3. When timing chip U3 times out, Q14 of timing chip U3 goes to high, forcing output 10 of gate U2*c* to high, output 4 of gate U2*b* to low and output 11 of gate U2*d* goes to high stopping and resetting timing chip U3. The alarm condition is, of course, only disabled when timing chip U3 is timing. The stopping and resetting of timing chip U3 results in the resumption of the alarm.

A portion of the circuit, identified by reference numeral 40, provides for central monitoring of the use of the electric appliance. Auxiliary output circuit 40 includes gates U1*b* and U1*c*. When current is sensed a low signal is sent to gate U1*b*, when an alarm condition is sensed a high signal is sent to gate U1*c*. This is a useful function in a seniors residence where the use of the stove in each unit can be monitored from a central location. The monitoring can be accomplished in a number of ways, three of which are illustrated; light emitting diode D4, opto-isolator U9 and relay JWD-171-14.

Referring to FIG. 3*b*, there is illustrated timing circuit 30*d* and stove shut off 38. Timing circuit 30*d* includes timing chips U10, U11, gates U5*a*, U5*b*, U5*d*, U6*a*, U6*b*, U6*c*, U6*d*, resistors R10, R12, R13, R17 and capacitors C16, C17. Timing chip U10 is a 30 minute timer. Timing chip U11 is a 7.5 minute timer. Output Q14 of timing chip U10 is low, which causes output 3 of gate U6*a* to go high. R12/C16 ensure that timer U10 is enabled during power up in a known condition, this results in a resistor/capacitor delay after which input 9 to gate U6*c* also goes to high. When snooze button 22 is pressed, output 4 of gate U6*b* goes to high, which makes input 13 to gate U6*d* high. Gate U6*d* starts and resets timing chip U10. Input 12 to gate U6*d* comes from the other portion of timing circuit 30*d*. An alarm condition exists when current is present, but the snooze button has not been pressed. The alarm condition resets and starts timing chip U11 timing. Initially output Q12 of timing chip U11 is low, causing output 11 of gate U5*d* to go to high. However, after timing chip U11 times out, output Q12 goes to high, causing output 11 of gate U5*d* to go to low. Capacitor C20 provides for the transition from high to low of input 1 to gate U5*a*. The presence of current causes input 6 of gate U5*b* to go to low, causing output 4 of gate U5*b* to go to high. This makes input 12 into gate U6*d* high, with input 13 of gate U6*d* already high, output 11 of gate U6*d* goes to low resetting and starting timing chip U10. D8 and C21 ensure that timing chip U10 is not running on initial power up.

An alarm condition exists when current is present indicating that the stove is operational and the snooze button has not, as yet been pressed. This alarm condition to input 12 of timing chip U11, resets timing chip U11 and starts the 7.5 minute timer timing down. The presence of current causes input 6 of gate U5*b* to spike low, causing output 4 of gate U5*b* to go high. When output 4 of gate U5*b* goes to high, input 12 of gate U6*d* goes to high. Input 13 to gate U6*d* is already high when the stove is on, which causes output 11 of gate U6*d* to go to low resetting timing chip U10 which starts timing down. Should no further alarm conditions reset timing chip U11, it times out spiking down input 1 to gate U5*a* causing output 3 of U5*b* to go to high. This causes output 4 of gate U5*b* to go to low, resetting timing chip U10. As long as the stove has not been turned off, timing chip U10 will then time down.

If the snooze button 22 is not pressed to reset timing chip U10, the circuit shuts the stove off when timing chip U10 times out. Stove shut off 38 includes gate U5*c*, resistors R10 and opto-isolators U14 and terminal switches T2.1 and T2.2. When output 4 of gate U6*b* is high, output 10 of gate U5*c* is low. When timing chip U10 times out, output Q14 goes to high, causing output 3 of gate U6*a* to go to low, causing output 10 of gate U6*c* to go to high and output 4 of gate U6*b* to go to low. When output 4 of gate U6B goes to low, output 10 of gate U5*c* goes to high with opto-isolators U14 and terminal switches T2.1 and T2.2 shutting the stove off.

There are a number of different products which stem from this invention. There can be a simple reminder, to remind a keep a person in close proximity to remain on task. There can be a call back feature, to call a person who may be at a distance and alert others in the house, usually the spouse. There can be an automatic shut off feature, that shuts the appliance off should the memory impaired person not respond to a call back within a specified period of time. What features are required depend upon the degree of impairment of the individual. For severely impaired individuals, alerting the spouse or others in the house can be of importance.

It will be apparent to one skilled in that art that a timer may be directly coupled with sensor 28. With this construction the timer, times a predetermined time interval upon receiving a signal from sensor 28. The alarm could be coupled with the timer to provide an audible tone upon receiving a signal from the timer that the predetermined time interval had expired. The timer would have a manual reset switch and would operate substantially as described above. It will also be apparent to one skilled in the art that other modifications may be made to the illustrated embodiment without departing from the spirit and scope of the invention as hereinafter defined in the Claims.

The embodiments of the invention in which an exclusive property or privilege is claimed are defined as follows:

1. A safety apparatus for electric appliances, comprising:

sensing means for sensing that an electric appliance is operating:

auditory alarm means coupled with the sensing means, whereby said alarm is initiated upon the electric appliance operating, the alarm continuing as long as the electric appliance continues to operate; and alarm disabling means for disabling the alarm means for a predetermined time interval while the electric appliance is operating, the alarm disabling means having a reset switch whereby the predetermined time interval is restarted.

2. A safety apparatus for electric appliances, comprising:

sensing means for sensing that an electric appliance is operating;

an auditory alarm means coupled with the sensing means, whereby said alarm is initiated upon the electric appliance operating;

alarm disabling means for disabling the alarm means for a first predetermined time interval while the electric appliance is operating, the alarm disabling means having a reset switch whereby the first predetermined time interval is restarted; and switch means for turning off the electric appliance should the alarm disabling means not be reset within a second predetermined time interval.

3. The safety apparatus for electric appliances as defined in claim 2, wherein the sensing means senses power consumption of the electric appliance.

4. The safety apparatus for electric appliances as defined in claim 3, wherein power consumption is monitored by sensing one of current and voltage.

5. The safety apparatus for electric appliances as defined in claim 2, wherein the alarm is audible.

6. A safety apparatus for electric appliances, comprising:

a power consumption sensor;

an audible alarm coupled with the sensor, whereby an audible alarm tone is initiated upon the electric appliance operating;

alarm disabling means for disabling the alarm for a predetermined time interval, the alarm disabling means having a manual reset switch whereby a person supervising the operation of the electric appliance restarts the predetermined time interval; and switch means for turning off the electric appliance should the alarm disabling means not be reset within a second predetermined time interval.

7. A safety apparatus for electric appliances, comprising:

a plug adaptor having a male portion adapted for insertion into a residential electric outlet and a female portion adapted to receive the plug from an electric appliance;

a power consumption sensor being electrically coupled with the plug adaptor, whereby power consumption by the electric appliance is monitored;

an audible alarm coupled with the sensor, whereby an audible alarm tone is initiated upon the electric appliance operating;

alarm disabling means for disabling the alarm for a predetermined time interval, the alarm disabling means having a manual reset switch whereby a person supervising the operation of the electric appliance restarts the predetermined time interval; and switch means for turning off the electric appliance should the alarm disabling means not be reset within a second predetermined time interval.

* * * * *